US006375486B1

(12) United States Patent
Yu

(10) Patent No.: US 6,375,486 B1
(45) Date of Patent: Apr. 23, 2002

(54) CARD CONNECTOR ASSEMBLY HAVING A RETENTION MECHANISM

(75) Inventor: Hung-Chi Yu, Hsi-Chih (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/875,885

(22) Filed: Jun. 6, 2001

(30) Foreign Application Priority Data

Dec. 30, 2000 (TW) ..... 89222897 U

(51) Int. Cl.[7] ..... H01R 4/50
(52) U.S. Cl. ..... 439/347; 439/59
(58) Field of Search ..... 439/345, 346, 439/347, 350, 629, 59

(56) References Cited

U.S. PATENT DOCUMENTS 5,126,954 A * 6/1992 Morita ..... 439/347
5,681,184 A * 10/1997 Pamant et al. ..... 439/347
5,876,226 A * 3/1999 Tsukakashi et al. ..... 439/347

* cited by examiner

*Primary Examiner*—Hien Vu
(74) *Attorney, Agent, or Firm*—Wei Te Chung

(57) ABSTRACT

A connector assembly comprises an edge card (4), a receptacle connector (5) and a retention mechanism (6). The edge card has an inserting portion (41) and an "L"-shaped fixing arm (42). The fixing arm has a vertical portion (420) and a downward horizontal portion (421). A gap (43) is defined between the vertical portion and the inserting portion. The receptacle connector has an insulative housing (51) defining a central slot (513), two sidewalls (512) and two external walls (516). The two sidewalls each define a recess (514) and a flute (515) defined on one bottom of the recess (514). The retention mechanism comprises a base (61) with a receiving cavity (65) therein and two connecting arms (62) extending forwardly form the base with a hook (621) on each of the connecting arm to connect with the flute firmly. The horizontal portion of the fixing arm inserts into the receiving cavity.

4 Claims, 3 Drawing Sheets

CARD CONNECTOR ASSEMBLY HAVING A RETENTION MECHANISM

BACKGROUND OF THE INVENTION

1. Field of the Invention

The present invention is generally related to a connector assembly, particularly to a connector assembly comprising a retention mechanism to keep an edge card in an edge connector firmly.

2. Description of the Related Prior Art

Usually, a connector assembly ensures an edge card firmly fixed in a card edge connector. Referring to FIG. 4, a conventional connector assembly comprises an edge card 1, a receptacle connector 2 and a retention mechanism 3. The edge card 1 has a main portion 10, an inserting section 11 and an L-shaped fixing arm 12 extending downwardly from the main portion 10. The fixing arm 12 defines a gap 14 between the lower edge of the main portion 10 and a horizontal portion 13 thereof. The receptacle connector 2 has an insulative housing 21 with a central slot 213 and a plurality of terminals 22 wherein the insulative housing 21 extends a connecting portion 211 from an edge thereof for cooperating with the fixing arm 12. The connecting portion 211 has a through hole 212. The retention mechanism 3 has a base 31 and two arms 32 protruding from the base 31 and defining a gap therebetween. After the inserting section 11 is inserted into the central slot 213 of the insulative housing 21, the fixing arm 12 will be adjacent to the connecting portion 211. Inserting the retention mechanism 3 through the gap 14 and the through hole 212, the separated resilient arms 32 may ensure the edge card 1 positioned in the central slot 213 of the electrical connector 2.

However, it is the two separated resilient arms 32 which joint the horizontal portion 13 and the connecting portion 211 together. The two resilient arms 32 will close up if the card is pulled improperly by a pull being larger than the resilience of the two resilient arms 32, then the edge card 1 will move a distance, and it causes the signal transmission unstable.

Hence, an improved connector assembly is required to overcome the disadvantages of the prior art.

BRIEF SUMMARY OF THE INVENTION

Therefore, an object of the present invention is to provide a connector assembly to hold an edge card in an electrical connector to transmit signals steadily.

To achieve the above-mentioned object, a connector assembly in accordance with the present invention comprises a receptacle connector, an edge card and a retention mechanism. The edge card has a main portion, an inserting section extending downwardly from the main portion and an "L"-shaped fixing arm. The fixing arm has a vertical portion and a horizontal portion extending downwardly from the main portion. The vertical portion and the fixing arm define a gap therebetween and the horizontal portion and the bottom edge of the main portion define a room therebetween. The receptacle connector comprises an insulative housing defining an engaging face, a connecting face, a central slot to receive the inserting section of the edge card and two sidewalls each define a recess parallel to the engaging face. A flute is formed at a bottom of each of the recesses. The retention mechanism has a base with a top section and two connecting arms extending from the base. The base defines a receiving cavity to receive the fixing arm and the connecting arms each have a hook to connect with the flute.

After the inserting section of the edge card has been inserted into the central slot and the retention mechanism has been approached to the insulative housing, the horizontal portion of the fixing arm positions in the receiving cavity and the top section of the base are inserted into the room between the horizontal portion and the bottom edge of the edge card and the hook of the connecting arm is received in the flute.

Other objects, advantages and novel features of the invention will become more apparent from the following detailed description of the present embodiment when taken in conjunction with the accompanying drawings.

DETAILED DESCRIPTION OF THE INVENTION

Figure 1:
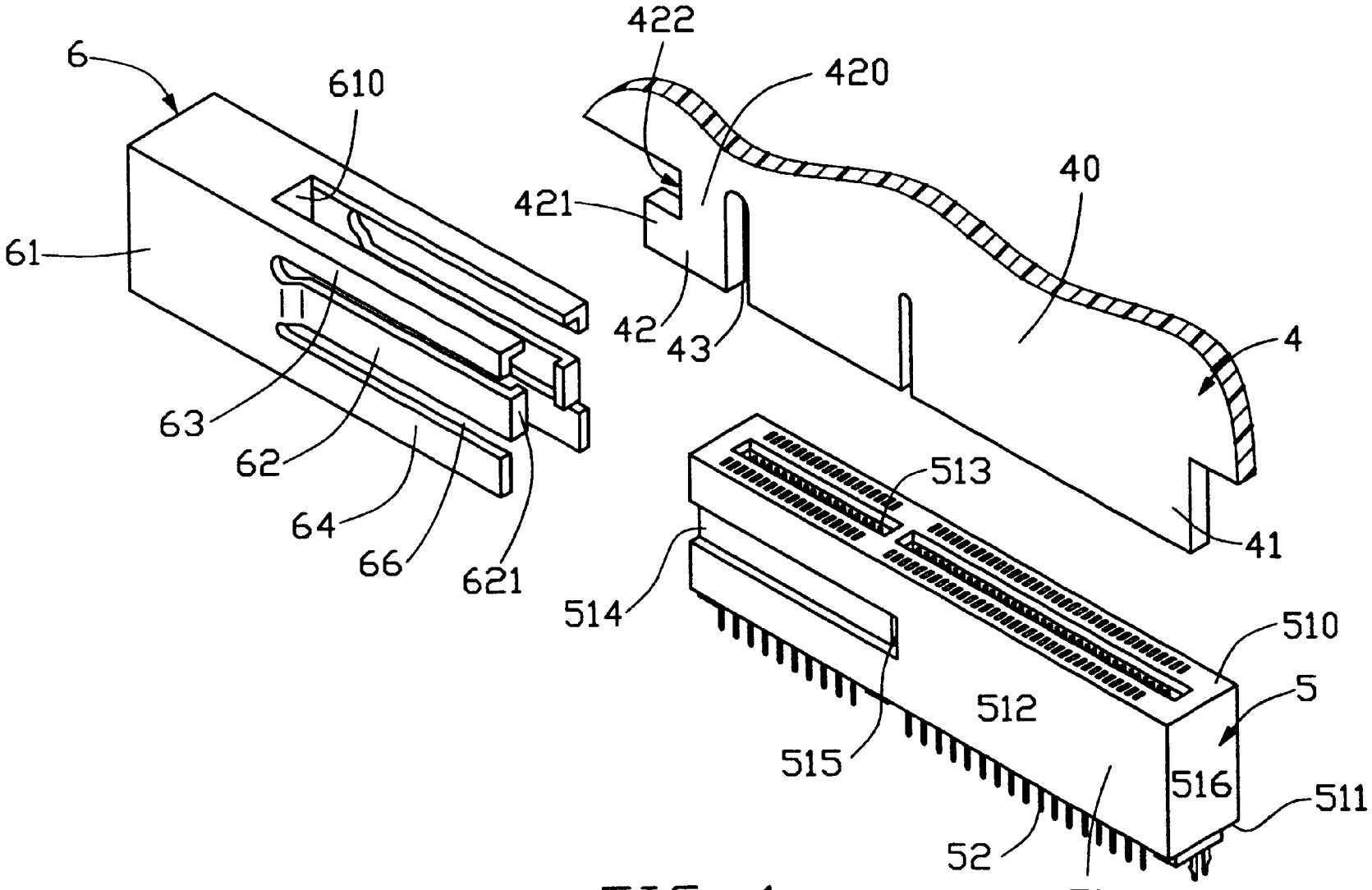
FIG. 1 is an exploded view of a connector assembly in accordance with the present invention.

Referring to FIG. 1, a connector assembly in accordance with the present invention comprises an edge card 4, a receptacle connector 5 and a retention mechanism 6.

The edge card 4 has a main portion 40 and an inserting section 41 extending downwardly from the main portion 40 and an L-shaped fixing arm 42 extending downwardly from the main portion 40. The fixing arm 42 has a vertical portion 420 and a horizontal portion 421. The vertical portion 420 and the inserting section 41 define a gap 43 therebetween and the horizontal portion 421 and the lower edge of the main portion 40 of the edge card 4 define a room 422 therebetween.

The receptacle connector 5 comprises an insulative housing 51 and a plurality of terminals 52 received in the insulative housing 51. The insulative housing 51 defines an engaging face 510, a central slot 513, two sidewalls 512 and two external walls 516. The two sidewalls 512 each define a recess 514 parallel with the engaging face 510 and a bottom of the recess 514 defines a flute 515.

The retention mechanism 6 includes a base 61 having a top portion (not labeled) and two connecting arms 62, two upper arms 63 with a slot (not labeled) therebetween for allowing the card 4 to extending therethrough, and two lower arms 64 extending forwardly therefrom. A hook 621 formed at the bottom of each connecting arm 62 to connect with the flute 515. The base 61 has a receiving cavity 65 (referring to FIG. 2) under the top portion 610.

Figure 2:
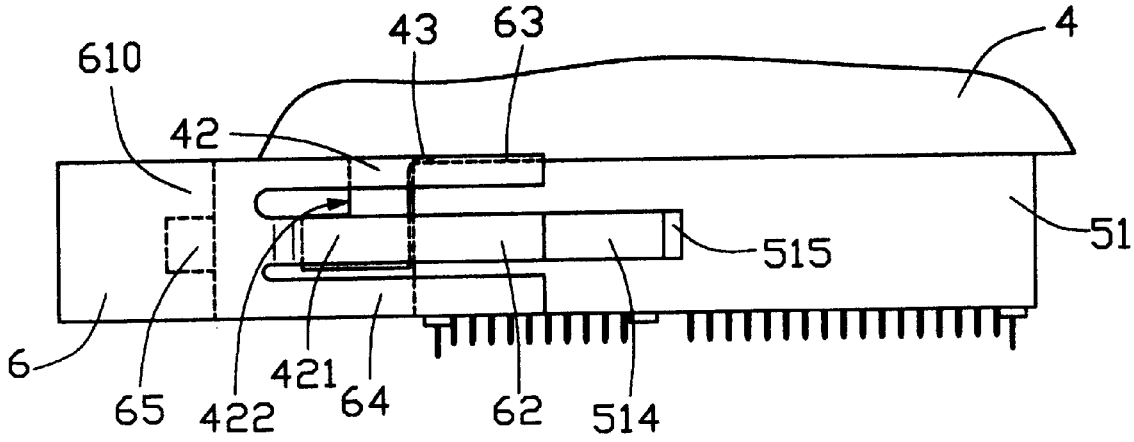
FIG. 2 is a schematic view of the first phase of assembling the connector assembly in accordance with the present invention.
Figure 3:
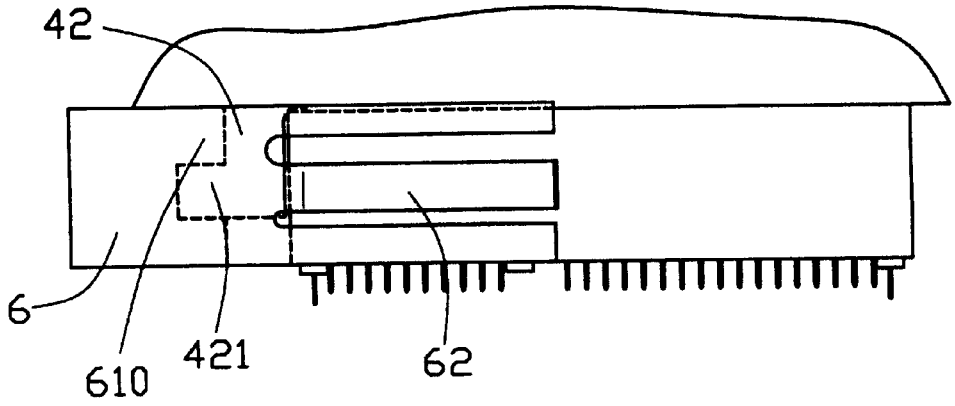
FIG. 3 is a schematic view of the second phase of assembling the connector assembly in according with the present invention.
Figure 4:
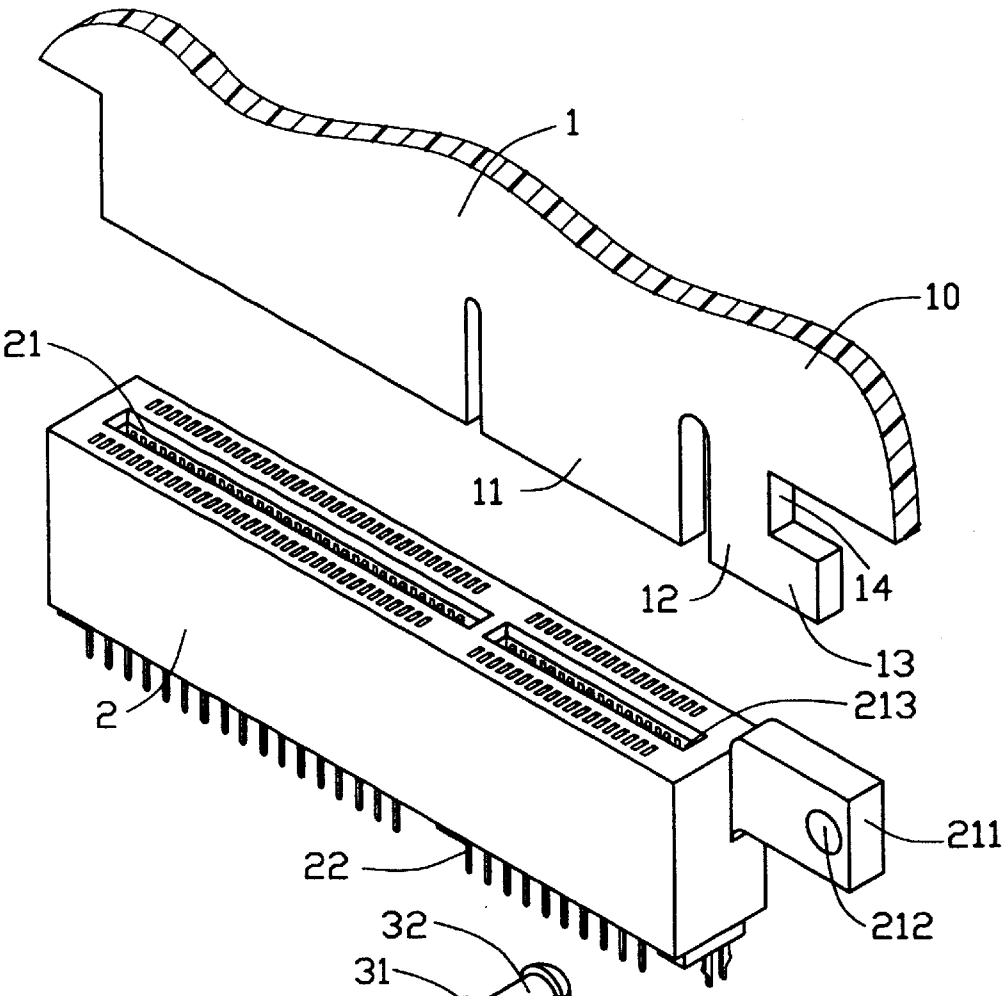
FIG. 4 (PRIOR ART)
FIG. 4 is an exploded view of a prior connector assembly.

Referring to FIG. 2, in assembly, after the inserting portion 41 of the edge card 4 has been inserted into the central slot 513 from the engaging face 510, the external walls 516 is inserted into the gap 43. The width of the gap 43 is equal to the thickness of the external wall 516, so the edge card 4 will be steady in the central slot 513 along the horizontal direction. Inserting the connecting arms 62 along the recesses 514 defined on the sidewalls 512 will make the two upper arms 63 and the two lower arms 64 attach to the sidewalls 512 closely, the horizontal portion 421 of the fixing arm 42 being positioned in the receiving cavity 65 and the top portion 610 insert into the room 422 between the horizontal portion 421 and the lower end of the edge card 4 firmly. The height of the top portion 610 is equal to the width of the room 422, so the edge card 4 will be steady in the central slot 513 along the vertical direction.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed. Understandably, the invention is to provide retention mechanism which is preferably horizontally installed to the connector housing in a lengthwise direction of the connector, and engages both the connector housing and the card for retaining the card within the connector housing. The connecting arms 62 of the retention mechanism 6 and the recesses 514 of the connector 5 are of one exemplary embodiment for combining the retention mechanism 6 and the connector 5. Anyhow, other equivalent structures are also applicable.

What is claimed is:

1. A connector assembly comprising:

an edge card having a main portion, an inserting portion and a fixing arm, said fixing arm having a vertical portion extending downwardly from said main portion and a horizontal portion connecting with said vertical portion, said inserting portion and said vertical arm defining a gap therebetween;

a receptacle connector comprising an insulative housing and a plurality of terminals received in said insulative housing, said insulative housing having a central slot for receiving said inserting portion of said edge card, two sidewalls and two external walls, one of said two external walls having a width equal to that of said gap, and a recess defined on each of said two sidewalls; and a retention mechanism comprising a base having a receiving cavity therein to receive said fixing arm and two connecting arms extending from said base to engage with said recesses; wherein said connecting arms are parallel with said fixing arm; wherein said base comprises two upper arms and two lower arms extending from said base of said connector assembly, and said upper arms and lower arms are parallel with said connecting arm and attach to the sidewalls of the insulative housing firmly; wherein each of said recesses defines a flute at one end thereof and said connecting arm has a hook to connect with said flute.

2. The connector assembly as claimed in claim 1, wherein said horizontal portion has a height equal to a width of said receiving cavity.

3. The connector assembly as claimed in claim 1, wherein said gap has a width equal to that of said external wall.

4. A card edge connector assembly comprising:

an insulative housing defining a central slot with two rows of terminals disposed by two sides thereof;

an edge card including a bottom portion received within the central slot, a portion of the edge card exposed outside one end of the housing with a room above a horizontal portion thereof; and a retention mechanism assembled to said one end of the housing along a lengthwise direction of the housing, said retention mechanism including a top portion received within the room and abutting against the horizontal portion of the edge card for preventing upward movement of the edge card after the retention mechanism is assembled to the housing; wherein said retention mechanism includes a pair of connecting arms for engagement with the housing; wherein said housing includes a pair of recesses for receivable engagement with the pair of connecting arms; wherein said retention mechanism includes a pair of upper arms and a pair of lower arms with a slot therebetween for allowing the edge card to extend therethrough.

* * * * *